US006311891B1

(12) United States Patent
Gardner

(10) Patent No.: US 6,311,891 B1
(45) Date of Patent: Nov. 6, 2001

(54) BLISS CONTAINER WITH E DIVIDER

(75) Inventor: Jeffrey M. Gardner, West Chicago, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/797,997

(22) Filed: Mar. 2, 2001

Related U.S. Application Data

(60) Provisional application No. 60/186,257, filed on Mar. 2, 2000.

(51) Int. Cl.[7] ..... B65D 25/04

(52) U.S. Cl. ..... 229/120.24; 229/120.26; 229/120.29; 229/164

(58) Field of Search ..... 229/120.24, 120.26, 229/120.29, 120.37, 122.21, 164

(56) References Cited

U.S. PATENT DOCUMENTS

| | | | | |
|---|---|---|---|---|
| 2,606,709 | | 8/1952 | Carey et al. . | |
| 3,099,379 | | 7/1963 | Stease . | |
| 3,214,076 | | 10/1965 | Gagnon . | |
| 3,348,667 | * | 10/1967 | Beeby | 229/120.37 |
| 3,905,541 | | 9/1975 | Paxton . | |
| 3,921,893 | * | 11/1975 | Randle, Jr. | 229/122.21 |
| 3,993,239 | | 11/1976 | Exel . | |
| 4,120,443 | * | 10/1978 | Gardner et al. | 229/120.24 |
| 4,197,789 | | 4/1980 | Moen . | |
| 4,333,600 | * | 6/1982 | Gardner | 229/120.26 |
| 4,376,507 | * | 3/1983 | Nauheimer | 229/120.24 |
| 4,601,687 | | 7/1986 | Gallaher . | |
| 4,793,494 | | 12/1988 | Gordon, Jr. . | |
| 4,955,502 | * | 9/1990 | Sorci | 229/120.24 |
| 5,143,278 | | 9/1992 | Petriekis et al. . | |
| 5,333,777 | | 8/1994 | Roth . | |
| 5,335,844 | | 8/1994 | Young . | |
| 5,419,485 | | 5/1995 | Petriekis et al. . | |
| 5,520,325 | * | 5/1996 | Quaintance | 229/120.29 |
| 5,950,915 | | 9/1999 | Moen . | |
| 5,967,406 | * | 10/1999 | Moorman | 229/164 |
| 5,975,413 | | 11/1999 | Moen . | |

* cited by examiner

*Primary Examiner*—Gary E. Elkins
(74) *Attorney, Agent, or Firm*—Christensen O'Connor Johnson Kindness PLLC

(57) ABSTRACT

A paperboard container is provided including an E divider and an outer portion formed about the E divider. The E divider includes a pair of divider panels at least one of which includes a front edge with a protrusion formed therealong. The outer portion includes a bottom panel with front and rear panels, a first outer side panel with upright front and rear panels, and a second outer side panel with upright front and rear panels. The lateral front panel includes an opening. As assembled, the lateral rear panel and the upright rear panels are coplanar and adjacent the E divider rear panels. The E divider front panels are coplanar with the lateral front panel, and the upright front panels surround portions of both. The at least one protrusion in the divider panel extends through the lateral front panel opening.

13 Claims, 5 Drawing Sheets

BLISS CONTAINER WITH E DIVIDER

CROSS-REFERENCE TO RELATED APPLICATION

This application claims priority to Provisional Application No. 60/186,257 filed Mar. 2, 2000, the benefit of which is claimed under 35 U.S.C. 119(e).

FIELD OF THE INVENTION

The present invention relates to shipping and display paperboard containers, and more particularly, to internally partitioned bliss containers of corrugated cardboard configured to attain high strength while economizing on the amount of material.

BACKGROUND OF THE INVENTION

Various types of bliss containers are known. In general, a bliss container includes at least one inner portion (or divider) and an outer portion (also called a body wrap or tray) adhered about the inner portion or portions. Bliss containers offer many advantages, most notably that they are stronger than most containers due to their having double and triple wall thicknesses. This makes bliss containers particularly advantageous for shipping and display purposes. See for example, U.S. Pat. No. 5,950,915 in which an H-divider bliss container is described.

Known bliss containers are useful, however they often require a merchandiser to rotate the container in order to display product remaining after the initial front products have been removed. Thus, a need exists for a high strength, stackable, bliss container in which such rotation is not necessary but rather product is visible throughout the interior of the container even as product is removed and as viewed from only one side. The present invention is directed to fulfilling this need and others, as described below.

SUMMARY OF THE INVENTION

In accordance with the teachings of the present invention, a paperboard container is provided including an E divider and an outer portion formed about the E divider. The E divider includes a pair of divider panels each having a front edge with a protrusion formed therealong. The outer portion includes a bottom panel with lateral front and rear panels, a first outer side panel with upright front and rear panels, and a second outer side panel with upright front and rear panels. The lateral front panel includes an opening. As assembled, the lateral rear panel and the upright rear panels are coplanar and adjacent the E divider rear panels. The E divider front panels are coplanar with the lateral front panel, and the upright front panels surround portions of both. The protrusions in the divider panel front edges extend through the lateral front panel opening.

Various alternative embodiments of the present invention are described. In one embodiment, the upright front panels are cut back in order to increase viewing into the interior of the container. In another embodiment, the E divider and the outer portion are formed of corrugated cardboard material having a fluted medium. When the E divider and the outer portion are erected, their respective flutes are vertically oriented. In yet another embodiment, each protrusion results from the forming of a notch in the divider panel front edge at a location above the divider panel at its lower edge. The protrusion is thus defined by the divider panel lower edge and the notch. In still another embodiment, as assembled, the divider panel front edges are generally coplanar with the exterior surface of the lateral front panel, with the lateral front panel passing through the front edge notches.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
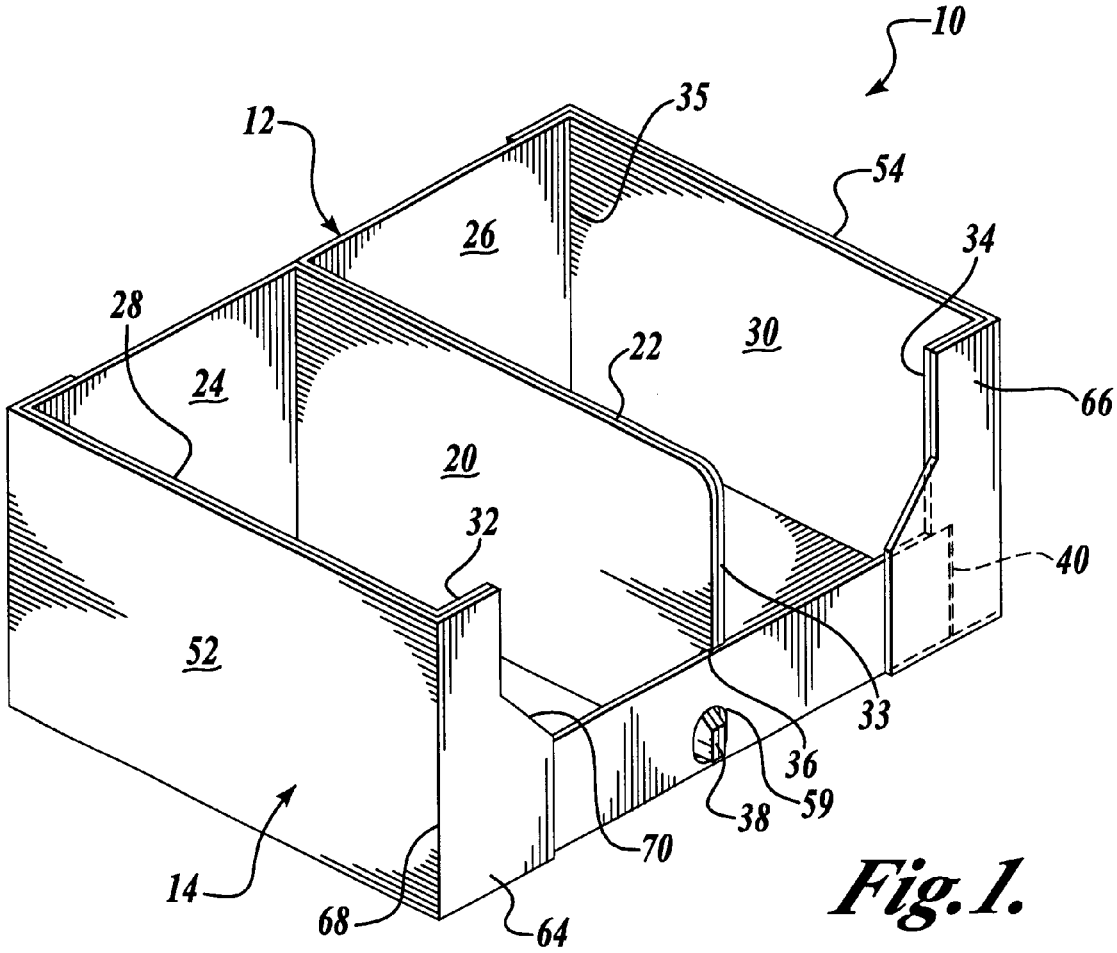
FIG. 1 is an orthogonal view of a container formed in accordance with the present invention, as assembled, with a comer feature shown in phantom.
Figure 2:
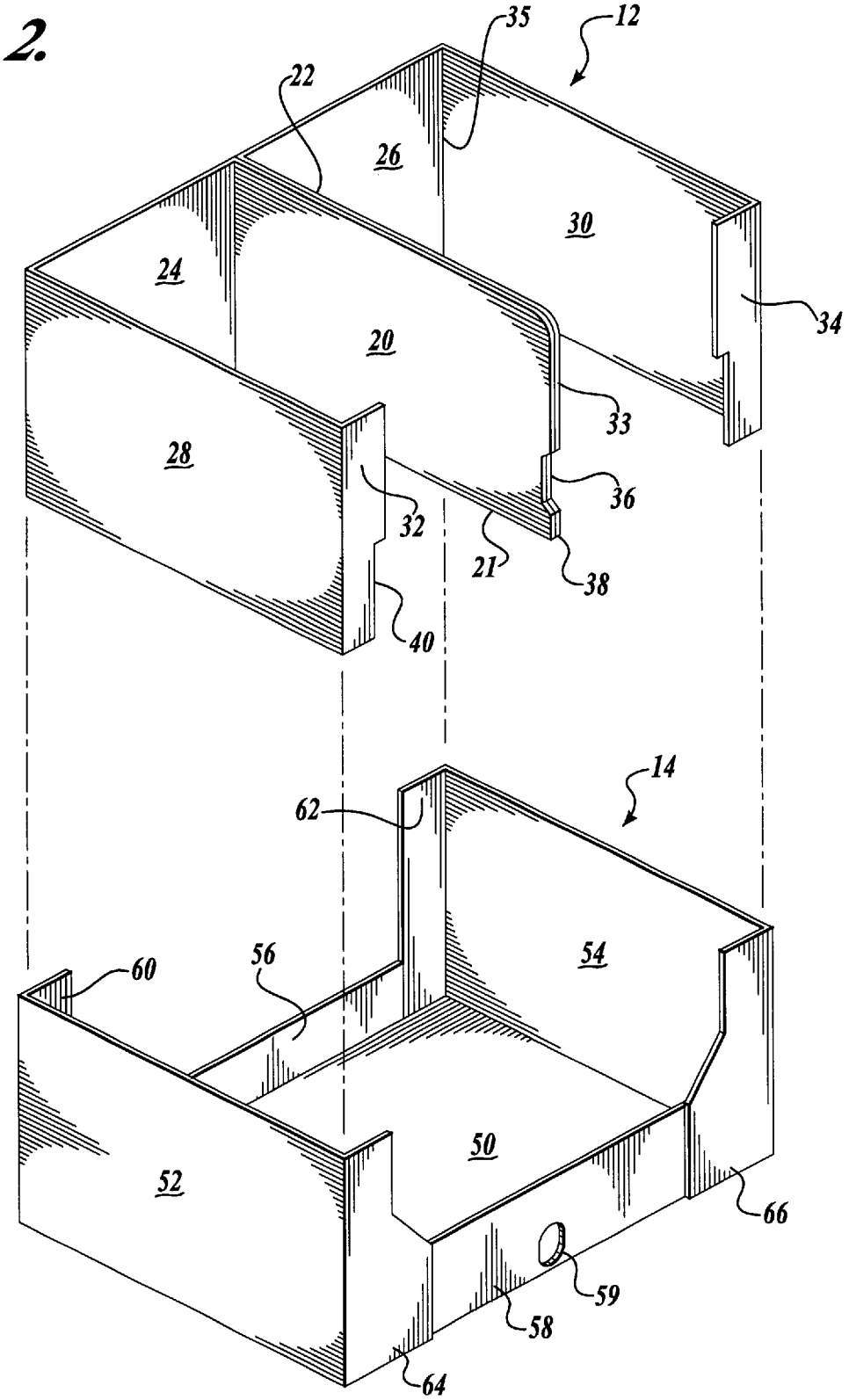
FIG. 2 is an exploded orthogonal view of the container of FIG. 1 showing an E divider and an outer portion.
Figure 3:
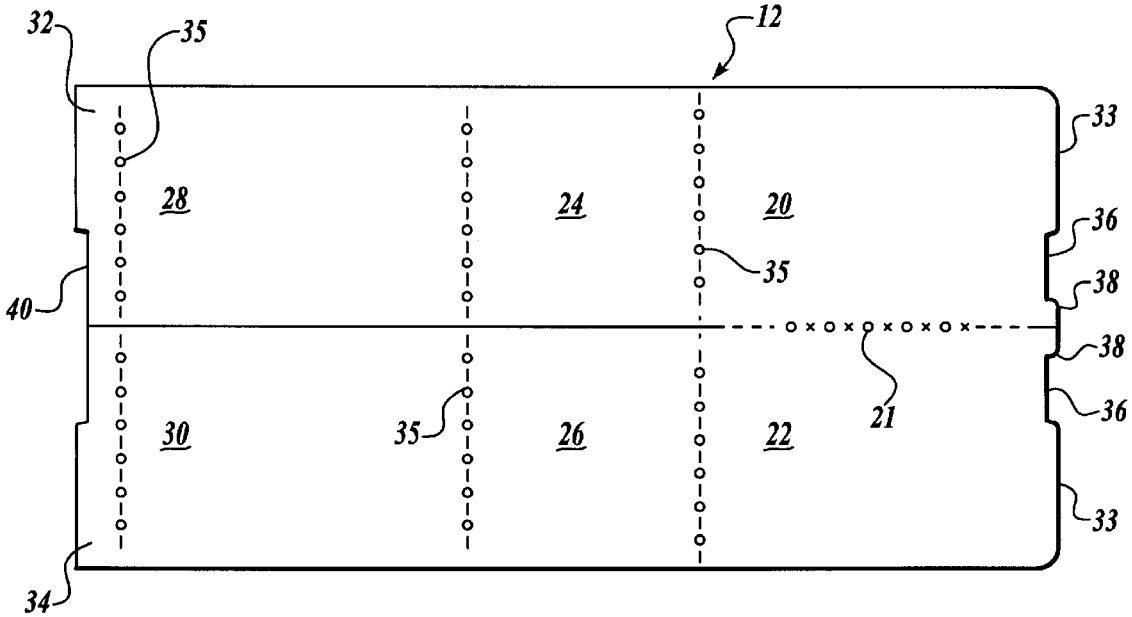
FIG. 3 is a plan view of the blank used to form the E divider shown in FIG. 3.
Figure 4:
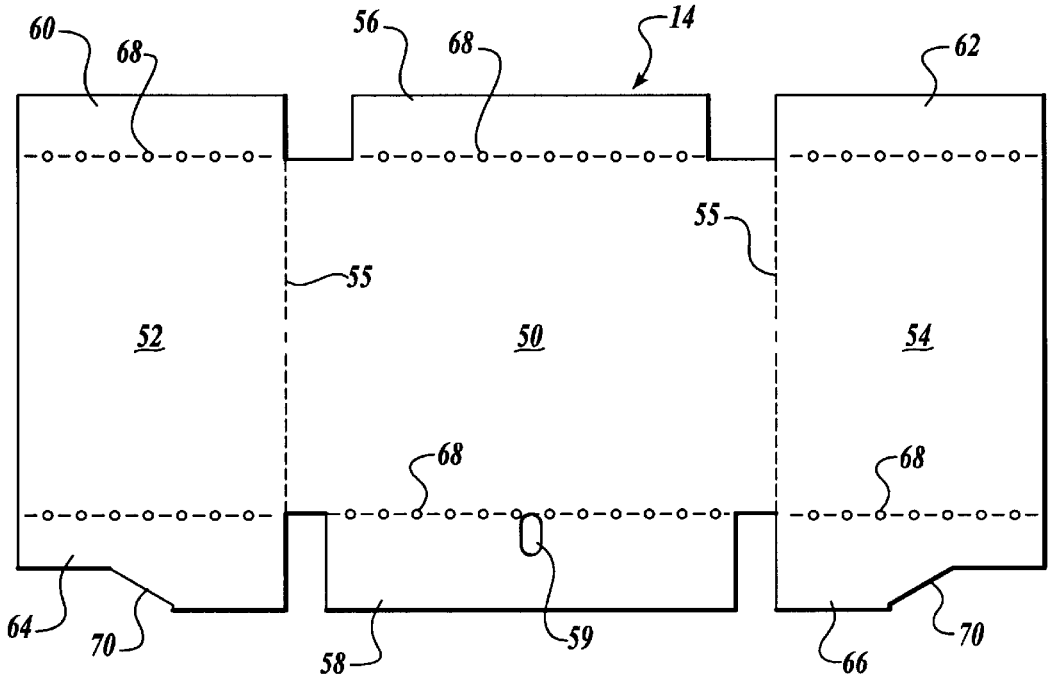
FIG. 4 is a plan view of the blank used to form the outer portion shown in FIG. 3.

Referring to FIG. 1, the present invention is a bliss container 10 having an E divider 12 and an outer portion 14. To assemble the container, the E divider 12 is formed and then the outer portion 14 is formed about the E divider 12. The outer portion 14 is preferably adhered to the E divider 12 during formation of the outer portion so that the container 10 remains a unitary object throughout its use. The outer portion 14 includes at least one side surface with a relatively large opening so that product within the container can be easily viewed. FIG. 2 is an exploded view of the container showing the relative placement of the E divider and outer portion. FIGS. 3 and 4 are plan views of the E divider and outer portion blanks.

In general, the E divider is formed from a single-piece blank and includes a pair of divider panels joined along a hinge line. Each divider panel is hingedly connected in series to a rear panel, a side panel, and a front panel. In more detail and referring to FIG. 3, the E divider 12 includes a first divider panel 20 connected in series to a first rear panel 24, a first side panel 28, and a first front panel 32. These panels are hingedly connected via score lines 35. A symmetrical image of these components is provided by a second divider panel 22, a second rear panel 26, a second side panel 30, and a second front panel 34. As with the first series, the second series panels are hingedly connected via similar score lines 35. The first and second divider panels are connected along a hinge line 21. The remaining panel pairs are not connected, but are cut therebetween instead. As shown in FIG. 3, the divider panel hinge line 21 is located parallel to and between each series.

Figure 5:
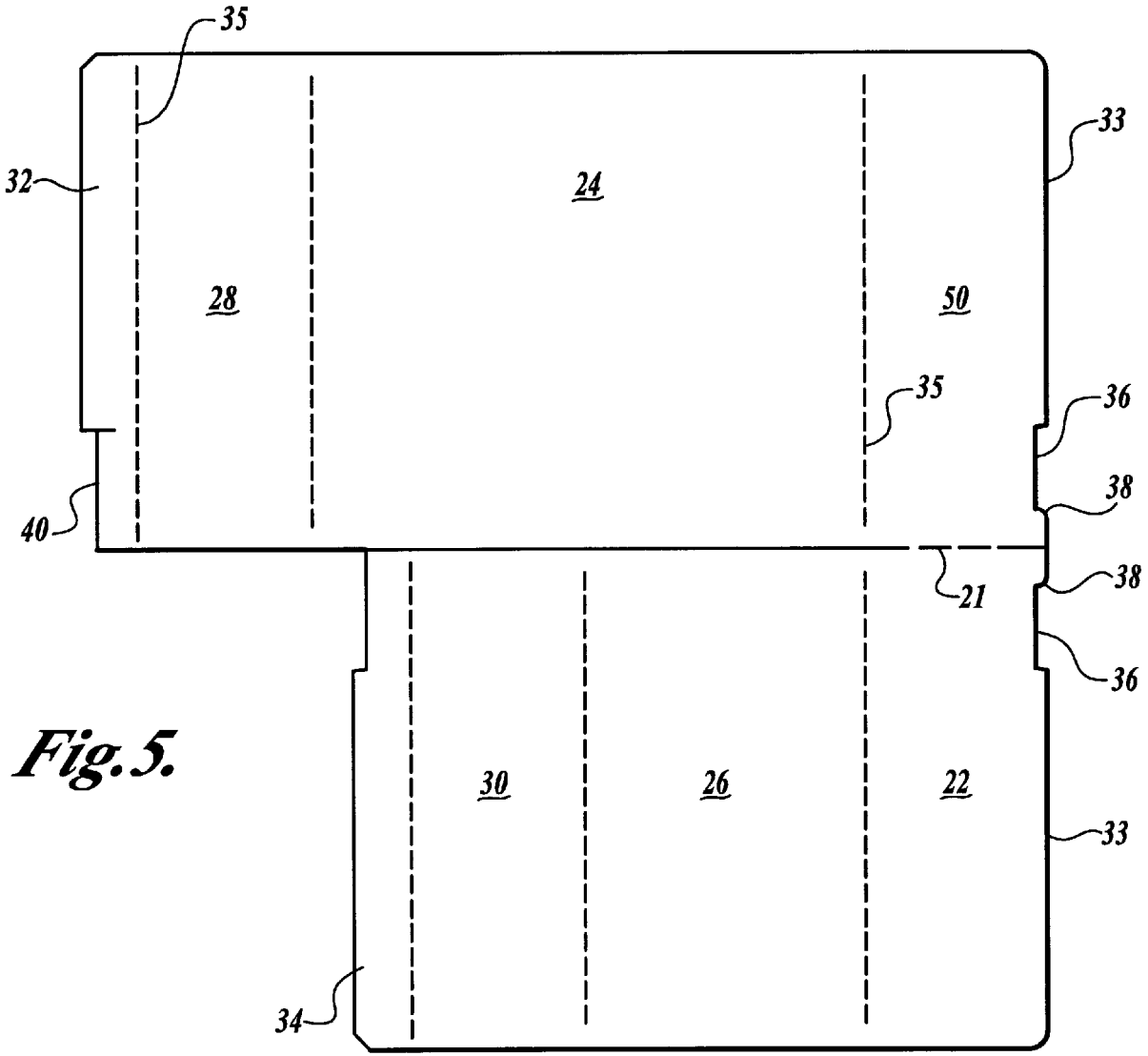
FIG. 5 is a plan view of a blank used to create another embodiment of an E divider formed in accordance with the present invention.
Figure 6:
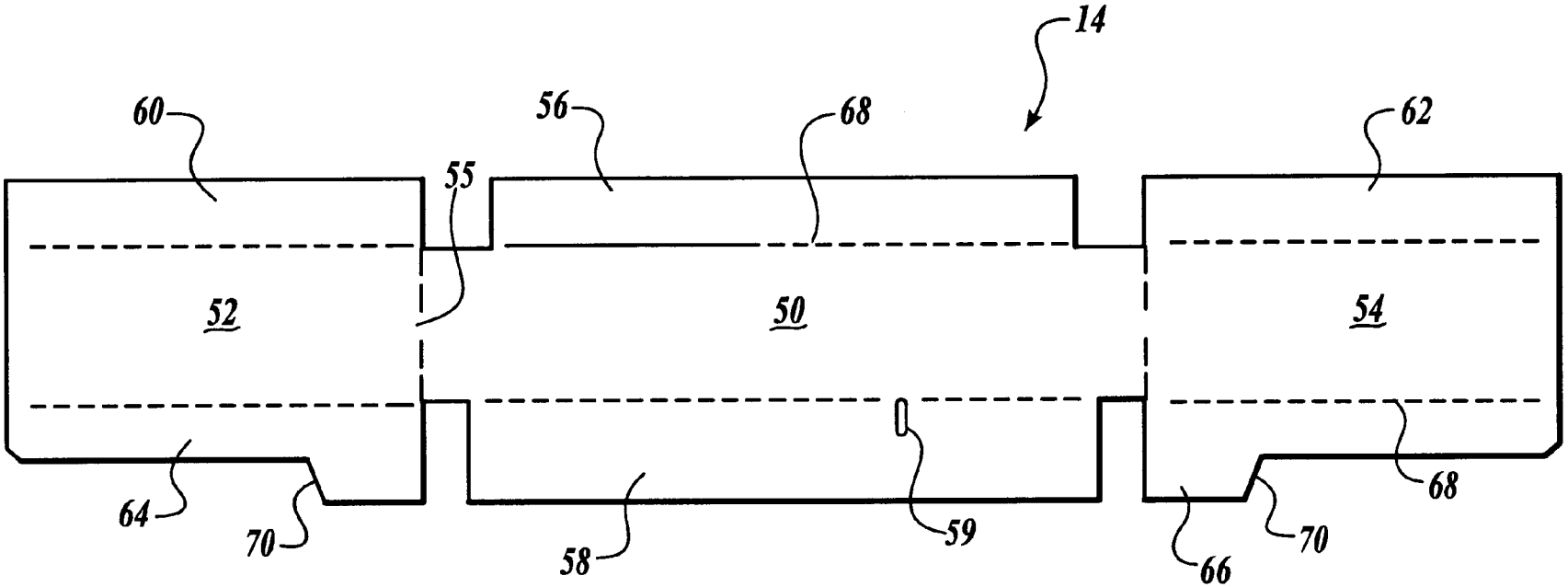
FIG. 6 is a plan view of a blank used to form an outer portion that may be used with such E divider shown in FIG. 5.

In one embodiment, the series are mirror images of one another. This results in an assembled E divider having equivalent sized portions formed between the divider panels. Alternatively, the series may be formed to result in a nonsymmetrical division of the assembled container. For example, the container may be divided as one-third and two-third sized sections or some other such combination. See, for example, the embodiment of FIGS. 5 and 6.

Nonsymmetrical dividing of the container is accomplished by elongating or shortening the rear panels 24 and 26 as necessary.

Still referring to FIG. 3, the first and second divider panels 20, 22 each include a front edge 33 located opposite the hinged connection to its respective rear panel. At least one of the divider panels has a protrusion 38 formed along its front edge 33. In the embodiment of FIGS. 1–3, both first and second divider panels 20, 22 include such a protrusion. Further in this embodiment, each protrusion 38 results from the inclusion of a notch 36 in the divider panel front edge at a location above the lower edge of the divider panel. The protrusion is defined as the front edge area between the divider panel lower edge and the notch 36. Also shown in FIGS. 3 and 1, the exposed edges of the first and second front panels 32, 34 preferably include a shoulder cutout 40 for mating with portions of the outer portion 14, as described below.

When erected, the E divider 12 is E-shaped with the divider panels 20, 22 forming the middle thine, the first and second side panels 28, 30 forming the lower and upper tines, the rear panels 24, 26 forming the connecting member, and the front panels 32, 34 forming the serifs.

This is accomplished by folding the first and second panel series along hinge line 21 so that they are coplanar and adjacent one another. As so folded, the notches 36 and protrusions 38 in the first and second divider panels align. With the first and second panel series adjacent one another and in an upright position, the first and second rear panels 24, 26 are folded away from one another in opposite directions. This results in the first and second rear panels being coplanar and essentially orthogonal to the first and second divider panels 20, 22. See FIG. 2. The first and second side panels 28, 30 are then folded orthogonal to the rear panels 24, 26, respectively. This results in the first and second side panels 28, 30 being positioned parallel to the first and second divider panels 20, 22. The first and second front panels 32, 34 are then folded inward so that they are essentially parallel with the first and second rear panels 24, 26.

Referring to FIG. 4, the outer portion 14 is formed from a single-piece blank having a bottom panel 50 positioned between a first outer side panel 52 and a second outer side panel 54. These components are hingedly connected along hinge lines 55. The bottom panel is also hingedly connected on its remaining opposed edges to lateral rear and front panels 56, 58. Both the lateral rear and front panels 56, 58 are of a width less than the overall width of the bottom panel for reasons described below. The lateral front panel includes an opening 59.

The first outer side panel 52 includes upright rear and front panels 60, 64 hingedly connected to opposed edges of the first outer side panel 52. Likewise, the second outer side panel 54 includes upright rear and front panels 62, 66 hingedly connected to opposed edges of the second outer side panel. The connection between the side and bottom panels 52, 54, 50 and their respective front and rear panels is accomplished via hinge lines 68. The first and second upright front panels 64, 66 each include an optional cutout 70 available to provide additional viewing of product within the container.

When formed, the outer portion 14 creates a tray about the E divider. The bottom panel 50 is oriented laterally. The first and second outer side panels 52, 54 are upright from the bottom panel 50 and are adjacent the E divider side panels 28, 30. The lateral rear panel 56 is also upright from the bottom panel 50 and is adjacent the E divider rear panels 24, 26. The lateral front panel 58 is upright from the bottom panel 50. The first and second upright rear panels 60, 62 are folded inward so that they are orthogonal to both the bottom panel 50 and their respective outer side panels 52, 54.

As shown best in FIG. 2, the sizing of the lateral rear panel 56 and first and second upright rear panels 60, 62 is such that, as assembled, these three panels are coplanar. The sizing of the lateral front panel 58 and the first and second upright front panels 64, 66 is such that, as assembled, these three panels are parallel though not coplanar. Instead, the lateral front panel 58 is coplanar with the E divider front panels 32, 34. The upright front panels 64, 66 surround portions of both the E divider front panels 32, 34 and the lateral front panel 58.

Referring back to FIG. 1, the protrusions 38 of the dividers 20, 22 extend through the opening 59 of the lateral front panel 58. The notches 36 in the front edges of the divider panels 20, 22 accommodate the remaining wall portions of the lateral front panel 58.

Assembly of the container 10 is preferably accomplished by first forming the E divider 12 as described above. Once formed, the E divider 12 is placed upright on the bottom panel 50 of the outer portion 14. Next, the first and second outer side panels 52, 54 are folded upright and glued to the exterior surfaces of the first and second side panels 28, 30 of the E divider 12. The lateral rear panel 56 is folded upward and glued to the exterior surfaces of the first and second rear panels 24, 26.

The upright rear panels 60, 62 are folded inward and also glued to the exterior surface of the first and second rear panels 24, 26. The lateral front panel 58 is folded upward so that the protrusions 38 extend through opening 59 and the corners of the panel 58 mate with whatever cutouts 40 are provided in the E divider front panels 32, 34. Lastly, the first and second upright front panels 64, 66 are folded inward and glued to the exterior surfaces of one or both of the lateral front panel 58 and the first and second front panels 32, 34.

As will be appreciated by those skilled in the art, various glue lines may be used to form the container. In one embodiment, glue is provided between overlapping panels. The placement of glue, in general, will vary depending on the particular application and the strength required.

In preferred embodiments, the E divider 12 and the outer portion 14 are formed of corrugated cardboard material comprising a fluted medium. When the E divider 12 and outer portion 14 are erected, their respective flutes are vertically oriented. In one embodiment, one or more of the various panels of the E divider and outer portion are double laminated to improve top to bottom container strength. In particular, the inventor herein has found it useful to double laminate the divider panels 20, 22, the E divider side panels 28, 30, and the outer side panels 52, 54.

As will be appreciated from viewing FIGS. 1 and 2, full viewing of the product inside the container is available from the front of the container due to the smaller height of the lateral front panel 58 and the front cutouts 70 in the upright front panels 64, 66. Various shapes and sizes of cutouts and front panels may be used according to the requirements of a particular application. The present invention container eliminates the need for a merchandiser to rotate the container in order to display product remaining after the initial front products have been removed. Rather, product is visible throughout the interior of the container even as viewed from only one side.

While the preferred embodiment of the invention has been illustrated and described, it will be appreciated that various changes can be made therein without departing from the spirit and scope of the invention. For example, the present invention container may be formed with various top lids and/or flaps. The container may be shrink wrapped for closure as well. The exterior surface of these walls and panels may be smooth so as to accommodate graphic arts such as advertising printings and stickers.

The embodiments of the invention in which an exclusive property or privilege is claimed are defined as follows:

1. A paperboard container comprising:

(a) an E divider formed from a single-piece blank, the E divider including a pair of divider panels joined along a hinge line; each divider panel being hingedly connected in a series to a rear panel, a side panel, and a front panel; each divider panel having a front edge; at least one of the divider panels having a protrusion along its front edge; and (b) an outer portion formed from a single-piece blank, the outer portion including a bottom panel with lateral front and rear panels hingedly connected to opposed edges of the bottom panel, a first outer side panel with upright front and rear panels hingedly connected to opposed edges of the first outer side wall panel, and a second outer side panel with upright front and rear panels hingedly connected to opposed edges of the second outer side panel; the bottom panel being hingedly connected on its remaining opposed edges to the first and second outer side panels; the lateral front panel including an opening; both the front and rear lateral panels having a width smaller than the width of the bottom panel;

wherein as assembled, the E divider forms an E shape and the outer portion is adhered to the E divider, as such the outer side panels are adjacent the E divider side panels, the lateral rear panel and the upright rear panels are coplanar to one another and adjacent the E divider rear panels, the E divider front panels are coplanar with the lateral front panel, and the upright front panels surround portions of both the E divider front panel and the lateral front panel; the protrusion in the at least one divider panel front edge extending through the lateral front panel opening.

2. The container according to claim 1, wherein the E divider front panels each include a shoulder cutout to accommodate portions of the lateral front panel.

3. The container according to claim 1, wherein the upright front panels each include a cutout to increase the view into the interior of the container.

4. The container according to claim 1, wherein the E divider and the outer portion are formed of corrugated cardboard material comprising a fluted medium and oriented such that when the E divider and the outer portion are erected, their respective flutes are vertically oriented.

5. The container according to claim 1, wherein glue is provided between overlapping panels of the container as assembled.

6. The container of claim 1, wherein as assembled, the lateral rear panel is substantially smaller in height than the E divider rear panels.

7. The container according to claim 1, wherein as assembled, the lateral front panel is substantially smaller in height than the outer side panels.

8. The container according to claim 1, wherein both divider panel front edges include a protrusion insertable into the lateral front panel opening.

9. The container according to claim 8, wherein each protrusion results from a notch formed in the divider panel front edge at a location above the divider panel lower edge; the protrusion being defined by the divider panel lower edge and the notch.

10. The container according to claim 9, wherein as assembled, the divider panel front edges are generally coplanar with the exterior surface of the lateral front panel, with portions of the lateral front panel passing through the front edge notches.

11. The container according to claim 1, wherein the E divider partitions the assembled container into portions of equal size.

12. The container according to claim 1, wherein the E divider partitions the assembled container into halves.

13. The container according to claim 1, wherein the E divider partitions the assembled container into portions of unequal size.

* * * * *